United States Patent [19]

Boie et al.

[11] Patent Number: 4,486,085

[45] Date of Patent: Dec. 4, 1984

[54] APPARATUS FOR DEVELOPING COLOR-PHOTOGRAPHIC IMAGES IN ETCHING ALKALINE SOLUTIONS ACCORDING TO THE COLOR DIFFUSION PROCESS

[75] Inventors: Immo Boie, Langenfeld; Guido Kovacic, Unkel; Victor Osegowitsch, Taufkirchen, all of Fed. Rep. of Germany

[73] Assignee: Afga-Gevaert Aktiengesellschaft, Leverkusen, Fed. Rep. of Germany

[21] Appl. No.: 462,664

[22] Filed: Jan. 31, 1983

[30] Foreign Application Priority Data

Feb. 10, 1982 [DE] Fed. Rep. of Germany ... 8203539[U]

[51] Int. Cl.³ ..... G03D 13/06

[52] U.S. Cl. ..... 354/312; 354/336; 354/338

[58] Field of Search ..... 354/312, 313, 314, 316, 354/331, 337, 338, 307, 310, 330, 336

[56] References Cited

U.S. PATENT DOCUMENTS

| | | | |
|---|---|---|---|
| 3,668,997 | 6/1972 | Ratowsky | 354/330 |
| 4,211,481 | 7/1980 | Bernhardt | 354/312 |
| 4,355,879 | 10/1982 | Faubert | 354/337 |

FOREIGN PATENT DOCUMENTS

| | | | |
|---|---|---|---|
| 522639 | 3/1931 | Fed. Rep. of Germany | 354/331 |

*Primary Examiner*—A. A. Mathews

*Attorney, Agent, or Firm*—Connolly and Hutz

[57] ABSTRACT

In order to develop color-photographic images by the color diffusion process, a first cylindrical container (1) for receiving the aqueous-alkaline working solution (4) is provided having a threaded bushing (7) on its upper edge and a contact safeguard (5) under the bushing. A second container (2) for receiving the image-wise exposed mono-sheet material (10) to be developed is also provided which has a threaded core (9), by which it may be screwed into the threaded bushing (7) of the first container (1) and may be tightly sealed therewith. Development takes place according to the overturning method and may be carried out in a lightroom.

7 Claims, 9 Drawing Figures

Figure 4:
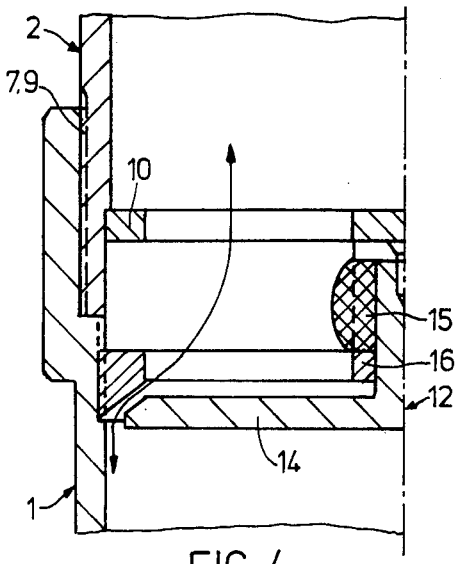

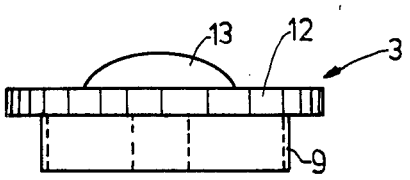
FIG. 3
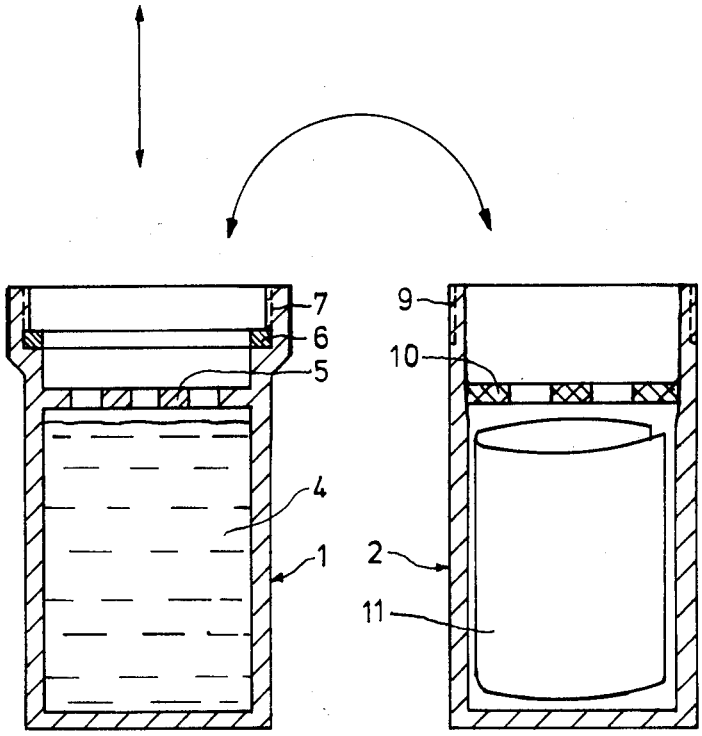
FIG. 1
FIG. 2

(A-A)

APPARATUS FOR DEVELOPING COLOR-PHOTOGRAPHIC IMAGES IN ETCHING ALKALINE SOLUTIONS ACCORDING TO THE COLOR DIFFUSION PROCESS

This invention relates to an apparatus for developing colour-photographic images according to the colour diffusion process, in which the image-wise exposed image sheet is brought into contact with an aqueous-alkaline working solution in a vessel by the overturning method.

In order to carry out the colour diffusion process, a photosensitive element is usually used which contains dye-producing compounds, and an image receiving element is used in which the desired colour image is produced by diffusing dyes which are transferred image-wise. For this purpose, it is necessary for there to be a firm contact between the photosensitive element and the image receiving element during the developing time, so that the image-wise distribution of diffusing dyes which is produced in the photosensitive element as a result of developing, may be transferred to the image receiving element.

The contact may be produced after developing has started, or may have already been produced before developing commences. The latter is the case, for example, if a material is used in which the photosensitive element and the image receiving element form an integral unit. Embodiments of the colour diffusion process are known in which an integral unit of this type remains even after the developing procedure has been completed, i.e., separation of the photosensitive element from the image receiving element is not provided even after the colour transfer has been completed.

According to German Offenlegungsschrift No. 3,045,183, an embodiment of this type comprises a transparent substrate, photosensitive elements, an opaque light-reflecting layer and an image receiving layer which together form a fixed laminated structure, into which an aqueous-alkaline solution may penetrate from the opposite side to the substrate.

For the production of colour copies, the image-wise exposure of the colour-photographic recording material is generally carried out in a darkroom, for example, in contact with a transparent coloured original, or by using a conventional projection enlarger.

A simple processing operation follows exposure and this essentially comprises bringing the exposed colour-photographic recording material into contact with an alkaline developer solution. This may be effected, for example, by immersing the material in a conventional manner into a suitable developer bath or by applying a developer preparation in paste form on to the image receiving layer of the colour-photographic material. Instead of liquid or viscous developer preparations, simple alkaline baths or pastes may also be used if the necessary developer substances, for example, phenidone or derivatives thereof, are embedded in one or more layers of the colour-photographic recording material, for example in the image-receiving layer, in the opaque light-reflecting layer or in one or more layers of the photosensitive element. Development using liquid developer baths may be carried out in trays or tanks.

The colour-photographic recording material according to German Offenlegungsschrift No. 3,045,183 may be brought into the light after an initial dark processing time of from one to two minutes, so that the formation of the colour transfer image may be observed in the image receiving layer without the subsequent exposure exerting an appreciable influence on the colour image to be produced. It is true that the silver halide development is not concluded at that stage and subsequently exposed silver halide continues to be developed, which is shown by the fact that the photosensitive element which is visible through the transparent substrate becomes darker, but this does not substantially affect the quality of the colour image to be produced. Thus, it is possible to observe the formation of the colour transfer image and to stop the developing process, when desired, or the subsequent diffusion of the image dyes once a sufficient colour density has been achieved, in that, for example the recording material is rinsed or is immersed in a mildly acid stop bath so that the pH in the colour photographic material is lowered to such an extent that the dye anions which had been released up until then are converted into the corresponding dye acids which are no longer capable of diffusion, and a stable image is obtained.

The use of strong alkaline working solutions of a high pH for developing the image-wise exposed image sheets in the dark according to the described process, may result in considerable damage to the apparatus and may also result in injury to the processor due to etching. Moreover, handling etching liquids in the dark is a troublesome operation.

Developing containers are known, into which the material to be developed is introduced in the dark and the container is then sealed. The different chemical solutions are successively introduced into the container in the light through inlet and outlet valves or openings and are then drawn off again after the reaction thereof. After development, the container is opened and the developed material, for example, a photographic paper or a film is removed, rinsed and dried. The construction and function of these apparatus is very complicated and they are unsuitable for developing standard images according to the colour diffusion process.

German Pat. No. 522,639 discloses a pocket darkroom which comprises a rectangular element for accommodating a photographic plate. The element is provided with a thread and may be screwed on to the bottles containing developer solution, fixer solution and water. During the sealing together of the two parts, a ball valve is opened, so that the chemical solutions gain access to the photographic plate and are able to react therewith. The apparatus is of a very complicated design and is unsuitable for the above-described developing process according to the colour diffusion process due to the risk of etching when alkaline working solutions are used.

An object of the present invention is to provide an apparatus for developing colour-photographic images according to the colour diffusion process, with which apparatus it is easily possible to develop the images as far as possible in the light and to avoid etching or damage caused by the aqueous-alkaline working solution.

This object is achieved according to the present invention with an apparatus of the initially mentioned design, in that a cylindrical container to receive the working solution is provided with a threaded bushing on its upper edge and with a contact safeguard, below the bushing, and another cylindrical container which contains the image-wise exposed mono-sheet material to be developed and a holding device for the mono-sheet material and has a threaded core by which it may be screwed into the threaded bushing of the container and may be tightly sealed therewith.

The developing apparatus according to the present invention is surprisingly simple in production and handling. It affords adequate protection against contact with the alkaline solution in the container and prevents the sheet to be developed from falling out when the container holding the sheet is tilted so as to be screwed on to the container holding the working solution.

The processing operation of the mono-sheet material is extremely simple using the apparatus according to this invention. The mono-sheet is exposed image-wise in the darkroom using a conventional colour enlarger and is introduced into a container 2 and is prevented from falling out by being secured with a holding device.

The container 2 is screwed on to container 1 and may then be brought into a lightroom. By tipping up the container 1, the mono-sheet material is brought into contact with the working solution. In the case of mono-sheet material according to German Offenlegungsschrift No. 3,045,183, it is unnecessary to control the temperature of or move the working solution during the developing period. The developing procedure is already completed after 1 or 1½ minutes. The two containers are again overturned so that the working solution returns to its container.

The container holding the mono-sheet material is unscrewed in the light, the remainder of the working solution which may still be inside is removed by rinsing, and the mono-sheet material is removed and dried as usual. The working solution may be used for many successive developments of mono-sheets.

In a very simple embodiment, the safeguard against contact which prevents access into the alkaline working solution may be a perforated disc which has a plurality of holes which are, for example less than five millimeters in diameter.

In a further developed embodiment of the apparatus, the contact safeguard in the container holding the working solution is a valve which may only be opened by screwing the other container on to the container holding the working solution, and which otherwise tightly seals the container.

This embodiment has the major advantage that even if the container is overturned, no alkali solution can come out and cause any damage, which is of particular advantage when the apparatus is handled in the dark.

When it is not being used, the container holding the working solution may be hermetically sealed with a sealing element which has a threaded core, and thus may be used as storage container. Consequently, a return filling operation to the original stock bottle is unnecessary.

In a simple and financially favourable embodiment, the holding device which is to prevent the mono-sheet material from falling out may be a removable clamping ring. However, this embodiment necessitates the photosensitive material being screwed on to the working solution container in the darkroom in order to prevent undesirable exposure. An advantageous further development of the apparatus is distinguished in that the holding device comprises a removable labyrinth which lets the working solution enter and issue, but protects the inside of the container from light.

This further development shows the considerable advantage that the container holding the working solution may remain at all times in the lightroom and only the container for the mono-sheet material need be provided with the image-wise exposed sheet in the darkroom, this material is then simultaneously held by the holding device and protected against exposure.

An advantageous embodiment of the apparatus is distinguished in that the inside wall of the container is provided with longitudinal ribs which diminish adhesion of the mono-sheet material with the inside walls and facilitate the removal of the developed sheet.

An advantageous further development is characterised in that a removable annular or spiral insert is provided having inwardly directed longitudinal ribs, which is discontinuous such that the mono-sheet material may be inserted into the container in at least two windings without the image side to be developed touching itself.

This insert allows even longer formats of the mono-sheet material to be developed, for example strips, without the containers becoming unwieldy in terms of size. For this purpose, the image-wise exposed mono-sheet is simply inserted into the spiral insert and is positioned around the outer periphery thereof and is thus inserted into the container and is held by a holding device.

Embodiments of the present invention will now be described in more detail in the following, with reference to drawings.

Figure 5:
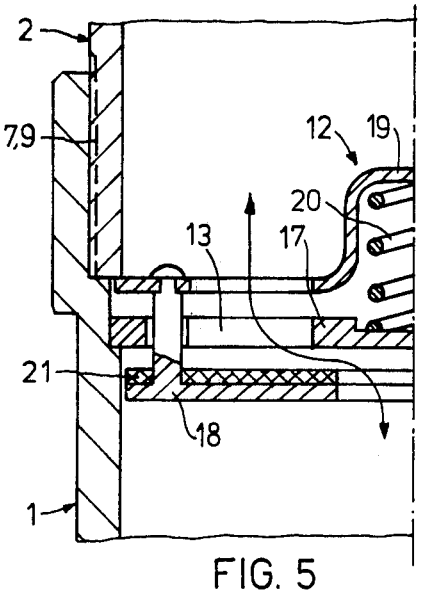
Figure 6:
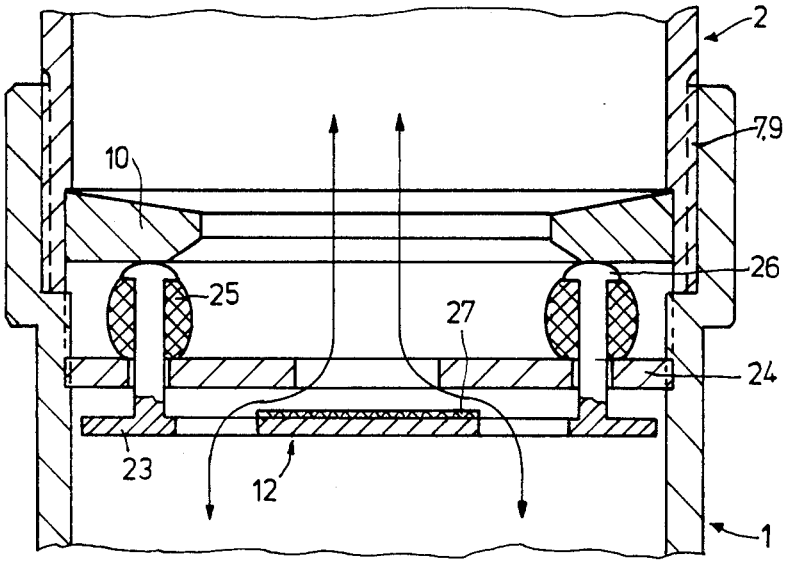
Figure 7:
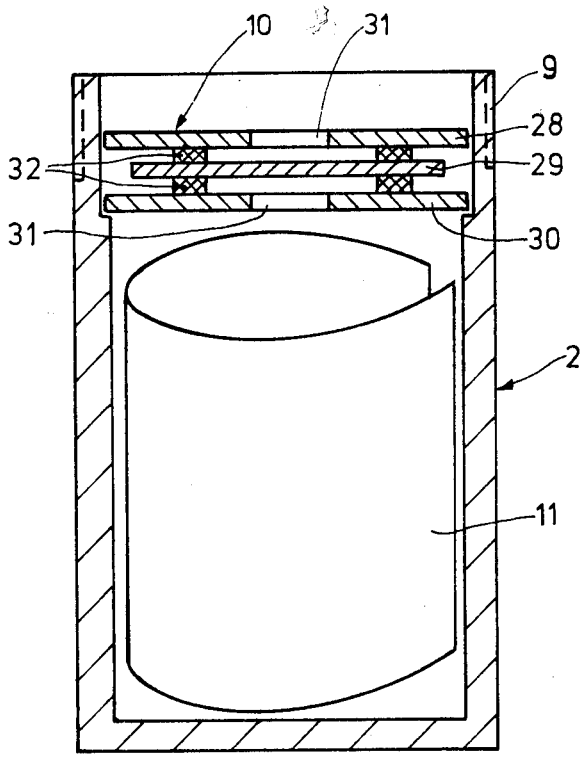
Figure 8:
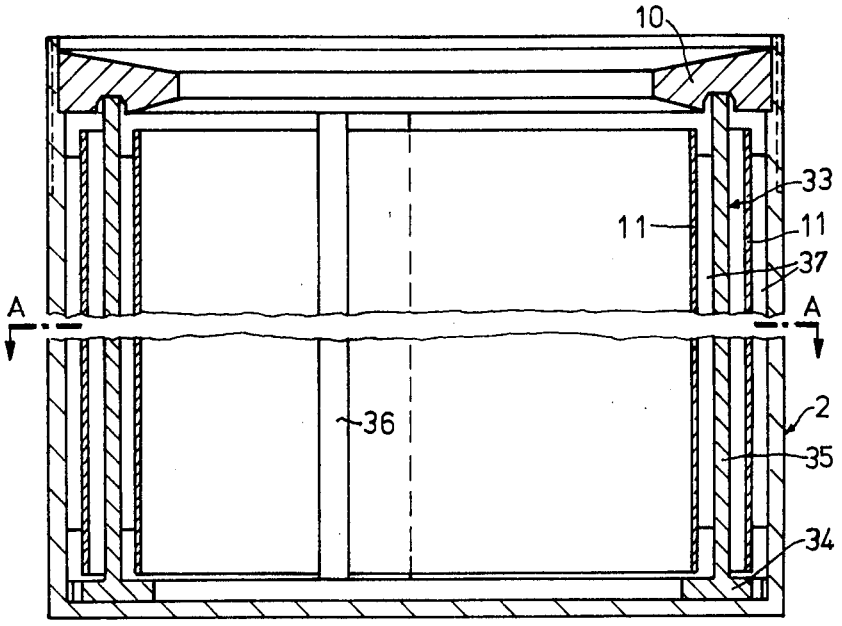
Figure 9:
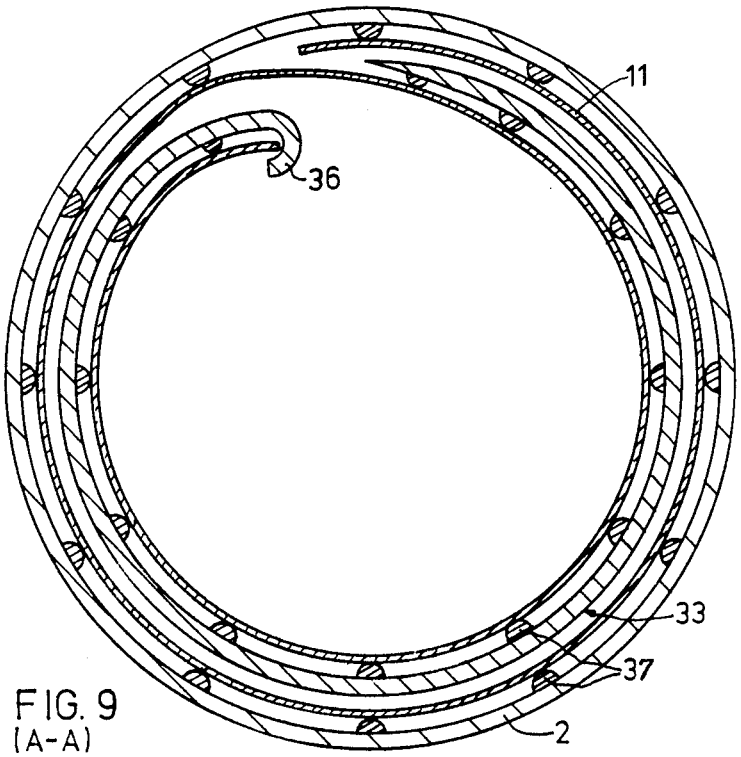

FIG. 1 illustrates in section, a container for the aqueous-alkaline working solution, FIG. 2 illustrates in section, a container for the mono-sheet material, FIG. 3 illustrates a sealing part for the container according to FIG. 1, FIGS. 4 to 6 illustrate valve devices for the container according to FIG. 1, FIG. 7 illustrates a container according to FIG. 2 having a labyrinth insert, FIG. 8 illustrates in longitudinal section, a container according to FIG. 2 having an additional insert for comparatively large sheet formats, and FIG. 9 illustrates a cross section through the container according to FIG. 8 along line AA.

FIGS. 1 and 2 illustrate the two essential parts of an apparatus for developing photographic images according to the colour diffusion process. The container according to FIG. 1 is cylindrical and has on its upper edge a threaded bushing 7 to receive container 2 according to FIG. 2. A rubber seal 6 is inserted below the thread to seal the two containers 1 and 2.

A contact safeguard 5 is inserted, for example, bonded, screwed or pressed into the cylindrical inside portion of the container 1. This safeguard 5 prevents any unintentional reaching into the container 1 which is filled with the etching aqueous-alkaline working solution 4. The threaded bushing is located on the container 1 in order to catch any alkaline solution which may still be dripping off when the containers 1 and 2 are unscrewed from each other.

The container 2 according to FIG. 2 is used for receiving an image-wise exposed mono-sheet material 11 and is provided with a threaded core 9. In order to prevent the inserted mono-sheet material from falling out while the two containers 1 and 2 are screwed together, a holding device 10 is inserted in the container after the mono-sheet material 1 has been introduced. In a simple embodiment, the holding device is a clamping ring which prevents the material from falling out, but allows a free flow of the working solution through openings which are provided.

FIG. 3 illustrates a sealing part 3 for sealing the container 1 when it is not being used. The sealing part 3 is provided with a threaded core 9 and has a rimmed edge 12 and/or a rib 13 for twisting the sealing part 3 into the thread of the container 1.

In general, the apparatus in this very simple and economical embodiment, is already reliable in operation and allows the perfect development of colour-photographic images in the above-described manner. For improved handling of the containers 1 and 2, they may be provided with grooves or edgings on a part of their outer periphery or over their complete periphery and these modifications facilitate the screwing-on and unscrewing operations. Since part of the apparatus is used in darkrooms, the containers 1, 2 may be provided with luminescent markings (not shown) which facilitate the detection of the upper and lower container 1, 2 and also facilitate the screwing operation.

In order to prevent the aqueous-alkaline working solution from coming out or to prevent direct contact with this solution, FIGS. 4 to 6 illustrate a further development of the apparatus, in which the container 1 is sealed with valves 12 until the container 2 has been screwed on to the container 1.

FIG. 4 illustrates a valve 12 which comprises a valve plate 16 and a valve seat 14. A rubber spring 15 presses the valve seat 14 against the valve plate 16 in the idle condition and seals off the container 1 hermetically. When the container 2 is screwed on to container 1, the holding device 10 presses against the rubber spring and opens the valve 12, so that the working solution 4 may flow in both directions, namely from container 1 to container 2 and vice versa (see the arrows). It is advantageous that the valve 12 is only opened when the holding device 10 has been inserted into the container 2 to secure the mono-sheet material and thus the material to be developed is held fast and cannot fall out.

FIG. 5 illustrates a valve 12 comprising a valve plate 17 which is secured in a fixed manner in the container 1 and has openings 13 which are sealed by a seal 21 on a valve seat 18 in the idle position. The seal is caused by a spring 20 which is located in a housing 19 and the housing is connected to the valve seat 18. When the container 2 is screwed on to container 1, the outer edge of container 2 presses the housing 19 against the spring 20 in a downward direction, so that the working solution may flow backwards and forwards between the containers (see the arrows). When container 2 is unscrewed, the valve 12 immediately re-closes.

Finally, FIG. 6 illustrates another advantageous embodiment of a valve 12 for sealing the container 1. This valve comprises a valve plate 24 which is fixedly positioned in the container, and a movable valve seat 23 which is pressed with its seal 27 against the valve plate 24 by rubber springs 25 and thereby seals off container 1 hermetically. When the container 2 is screwed on to container 1, then, in similar fashion to FIG. 4, the holding device 10 presses against the rubber springs 25, pressing them together, and opens the valve 12 so that the working solution may flow through (see the arrows).

The valve designs which have been described differ from each other in that the valve 12 according to FIG. 5 is operative even without a holding device 10, whereas the valves 12 of FIGS. 4 and 6 function in cooperation with the holding device 10. The valve 12 of FIG. 4 is actuated by the centre of the holding device 10 and is therefore more suitable for containers 1, 2 of a smaller diameter. The valve 12 of FIG. 6 is actuated on the edge 26 of the holding device 10 and is particularly advantageous for containers 1, 2 of a large diameter.

The valves 12 are screwed on to the container 1 so that they may be removed in order to clean or empty the container. However, they may also be welded or bonded into the container, in which case, for emptying and rinsing the container 1, a sealing part according to FIG. 3 which has bores (shown in dashed lines) is used to draw off the working solution and to admit rinsing liquids.

FIG. 7 illustrates an embodiment of the container 2 in which the holding device 10 is simply designed as a labyrinth. After the image-wise exposure of the mono-sheet material 11, the material is introduced into the container 2 and is secured by the labyrinth holding device 10 so that it cannot fall out and is protected against undesirable exposure.

The labyrinth-shaped holding device 10 comprises three or more circular plates 28, 29, 30, the bores or openings 31 of which are staggered such that the liquid may flow through, but light cannot pass through. In the embodiment which is illustrated by way of example, the top plate 28 has a centre bore 31 and is secured to the middle plate 29 by ridges 32. The middle plate 29 has a smaller diameter than the first plate 28. A plate 30 which has a centre hole 31 is secured by ridges 32 to the smaller plate 29. One or both of the plates 28, 30 are provided with a means by which they are secured in the container 2, for example with a thread, an insertion or twist seal (bayonet seal), or one plate 28, 30 is designed as a clamping plate and it clamps with the inside wall or in a groove located therein. The labyrinth may also be formed by other arrangements comprising a greater or smaller number of plates. One embodiment may also be envisaged in which two plates having bores may be twisted with respect to each other so that in a first position of the plates, the bores are concealed from each other and prevent light from coming through and, in a second position, they are positioned one above the other and grant the working solution free access. In this embodiment, the plates may be twisted with respect to each other by screwing container 2 into container 1, a stud (not shown) in container 1 causing the twisting of one of the plates.

Compared with a simple clamping ring, the labyrinth-design for the holding device 10 has the advantage that only container 2 has to be taken into the darkroom, the image-wise-exposed mono-sheet material is inserted there and container 2 is sealed with the labyrinth-type holding device. Screwing container 2 on to container 1, developing and removing the mono-sheet material may be carried out in a lightroom. During these procedures, the alkaline working solution always remains in the lightroom.

FIG. 8 illustrates a section through a container 2 along the axis, in which container an insert 33 has been introduced and is held by the clamping ring 10. The insert 33 comprises an annular disc 34, on which a partition 35 which is open on one side stands vertically. The partition 35 is used as a spacer for the mono-sheet material 11 so that a greater length of the material 11 may be introduced into the container 2 without the surface of the material 11 touching itself.

As shown in FIG. 9, a cross section through the container 2 of FIG. 8, the mono-sheet material 11 is either introduced into the container 2 from above or the insert 33 is is removed from the container, the mono-sheet material 11 is inserted tangentially along the partition 35 up to a shaped stop 36 and is then positioned around the insert 33 and is introduced into the container together with the insert and is held by the holding device 10. The device 10 may be a clamping ring or a labyrinth.

The insert 33 allows almost double the length of mono-sheet material 11 to be introduced into the container 2 and to be developed. The insert 33 may also be designed as a spiral so that the partition 35 performs several windings and may thus accommodate even greater lengths of the mono-sheet material 11 (not shown).

The inside walls of the container 2 and the insides of the insert 33 are advantageously grooved or provided with slightly inwardly projecting rounded-off ridges 37 which prevent an intimate contact between the sheet material 11 and the inside surfaces of the container 2 and the insert 33 and thus only cause a slight linear contact.

The apparatus is advantageously made of plastics material, but it may also be produced from high-grade steel.

Thus use of the apparatus is not only restricted to developing colour-photographic images, but is suitable, in the same way, for black and white images which are developed by the colour diffusion process or by using a fixer developer.

We claim:

1. In an apparatus for developing color photographic images in an image-wise exposed mono-sheet material in a color diffusion process by contact in an aqueous-alkaline solution, a first container capable of containing an aqueous-alkaline solution a second container capable of receiving an image-wise exposed and developable mono-sheet material, and having a holding means preventing a mono-sheet from falling out, means for making said containers sealable together while developing color photographic image in the apparatus by the overturning method, a contact safeguard means in said first container and having a valve mounted in said first container which prevents access to the etching solution through said safeguard means, said first container and said second container being so interrelated that sealing of the first and second containers opens said valve in said first container and said valve being so constructed and arranged so as to prevent access into the alkaline solution and the outflow of the alkaline solution prior to said sealing.

2. A combination as defined in claim 1, wherein said valve includes a seat member fixed in said first container and provided with a passage a movable valve member carried on said seat member and spring means biased to urge the movable valve member into sealing engagement with the fixed seat member and means associated with the second container engageable with the movable valve member to unseat the movable valve member from said sealing engagement upon sealing of the first and second containers.

3. An apparatus as claimed in claim 1 wherein the second container includes longitudinal ribs formed on the interior wall surface whereby adhesion is reduced between said interior wall surface of said container and the mono-sheet material received thereon.

4. An apparatus as claimed in claim 1 wherein the second container includes a movable annular or spiral insert having longitudinal ribs formed on the inner circumferential surface of the insert and the periphery of the insert is discontinuous whereby the mono-sheet material may be inserted into the second container and at least two windings without the image side to be developed being in contact with the mono-sheet material.

5. An apparatus according to claim 1, characterised in that the holding means provided to prevent the mono-sheet material from falling out, is a removable clamping ring.

6. In an apparatus for developing color photographic images in an image-wise exposed mono-sheet material in a color diffusion process by contact in an aqueous-alkaline solution, a first container capable of containing an aqueous-alkaline solution a second container capable of receiving an image-wise exposed and developable mono-sheet material, and having a movable labyrinth which prevents the mono-sheet from falling out and protects the mono-sheet material from light, means for making said containers sealable together while developing color photographic image in the apparatus by the overturning method, a contact safeguard means in said first container which prevents access to the etching solution in the first container.

7. An apparatus according to claim 6, characterised in that the safeguard against contact is a perforated disc.

* * * * *